United States Patent [19]

Richardson

[11] 4,034,513

[45] July 12, 1977

[54] STRUCTURAL MEMBERS FOR PANEL WALL AND DOOR MOUNTING

[76] Inventor: Cletus Richardson, 3419A Winnebago, St. Louis, Mo. 63118

[21] Appl. No.: 619,527

[22] Filed: Oct. 3, 1975

[51] Int. Cl.[2] ..... E06B 1/04

[52] U.S. Cl. ..... 49/504

[58] Field of Search ..... 49/504, 505; 52/211, 52/212

[56] References Cited

U.S. PATENT DOCUMENTS

| | | | |
|---|---|---|---|
| 1,266,547 | 5/1918 | Baxter | 52/211 |
| 2,826,282 | 3/1958 | Goldberg | 49/505 X |
| 3,239,978 | 3/1966 | Parker | 52/211 |
| 3,274,735 | 9/1966 | Stackhouse | 49/504 |
| 3,287,856 | 11/1966 | Passovoy | 49/504 |

*Primary Examiner*—William H. Schultz

*Attorney, Agent, or Firm*—Gravely, Lieder & Woodruff

[57] ABSTRACT

Structural members adapted to support wall panels and especially to accommodate the installation of doors in panelled walls, wherein the structural members combine to frame a door opening and support adjacent wall panels, and wherein the structural members are formed to fit together with the use of screws and simple tools.

4 Claims, 10 Drawing Figures

FIG. 6
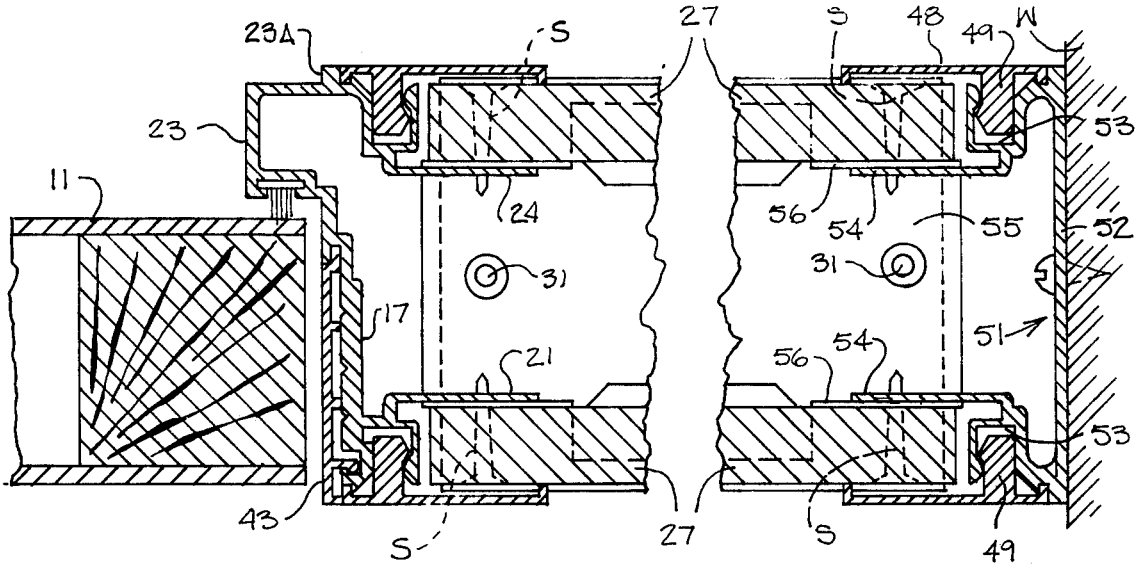
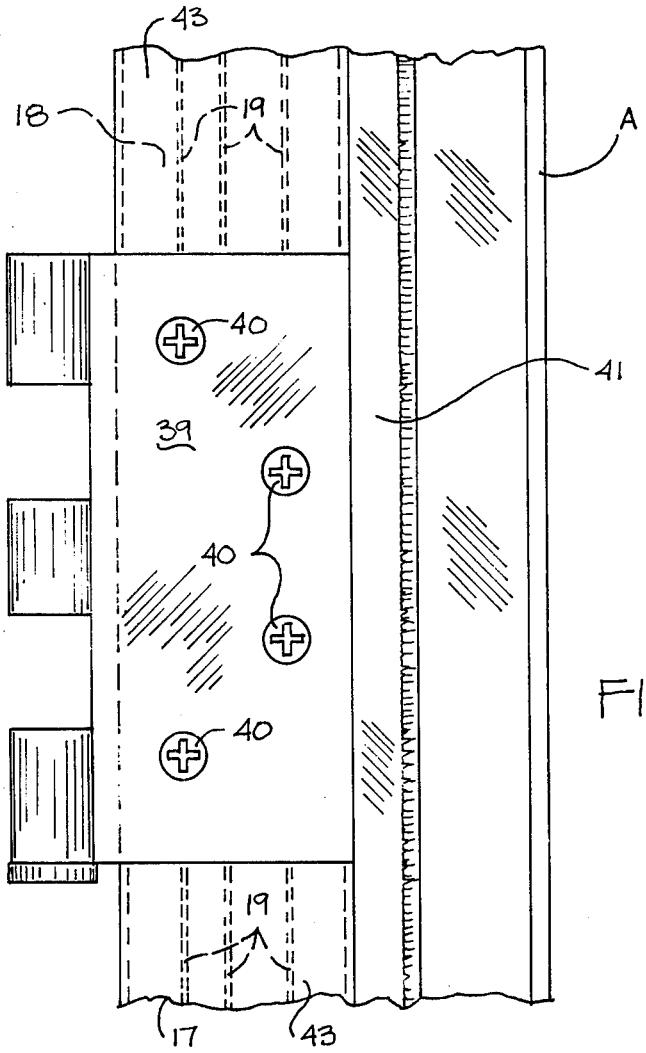
FIG. 5

STRUCTURAL MEMBERS FOR PANEL WALL AND DOOR MOUNTING

BACKGROUND OF THE INVENTION

The desirability of flexible interior wall systems is widely recognized and used, but the approach to systems of this character has developed complicated structural components needing a great amount of skill in effecting the installation, all of which raises the expense involved.

The present invention has recognized the problems and cost of installation of other systems, and has met the challenge by providing a group of structural members which fit together in easy and rapid manner and are compatible with the prior systems disclosed in my prior U.S. Pat. No. 3,629,984 granted Dec. 28, 1971, and the system disclosed in my pending U.S. application, Ser. No. 570,248, filed Apr. 21, 1975. In this application there is disclosed means for mounting doors in the wall panel system of my prior pending application, and of means for supporting wall panels in several modes of installation.

A principal object of this invention is to provide structural members which when assembled in a simple snap together manner will frame a door opening, fit with the wall panels around the door opening, and support the door, all of which presents a neat and clean appearance.

Other objects of this invention will be pointed out and will appear from the detailed description of presently preferred embodiments, a principal embodiment comprising an elongated structural member having an end face flanked along one margin by a recess and an anchor flange, flanked along the opposite margin by a door stop element which is combined with a recess and an anchor flange, trim strips carried by each of the recesses and held thereby in spaced relation to the outside of the anchor flanges, and a finishing strip carried adjacent the end face, the several parts of this embodiment being formed to fit together easily and neatly.

BRIEF DESCRIPTION OF THE DRAWINGS

The structural members of this invention are shown in assembly detail in the accompanying drawings, wherein:

FIG. 5 is a fragmentary view showing the door hinge mounting on a jamb stud taken along line 5—5 in FIG. 1;

FIG. 6 is a sectional view of a modification of the present structure;

DESCRIPTION OF THE EMBODIMENT

Figure 1:
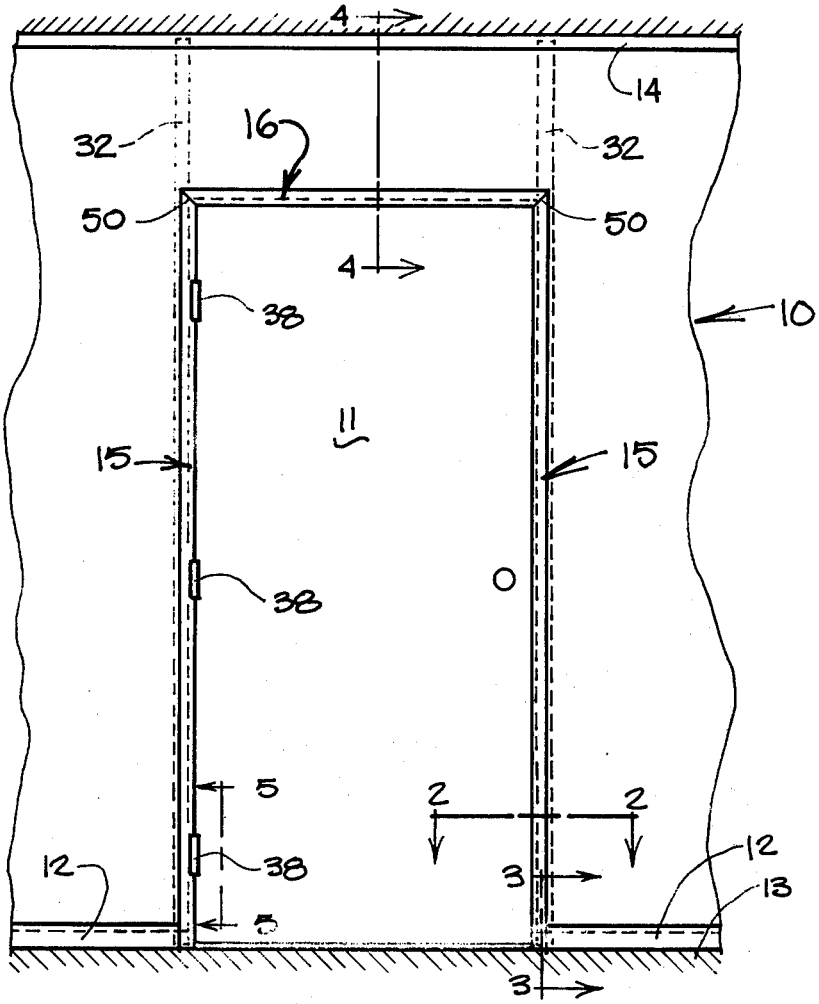
FIG. 1 is a fragmentary elevational view of a panel wall incorporating the structural members of this invention to frame an opening and support a door therein.

The view of FIG. 1 is a fragmentary part of a panel wall 10 in which a door 11 has been mounted. The wall 10 includes a base channel 12 anchored to the floor 13 and a ceiling channel 14. The door 11 is mounted in a frame which includes the jamb assemblies 15 and a header assembly 16 having a mitered fit with the jambs.

Figure 2:
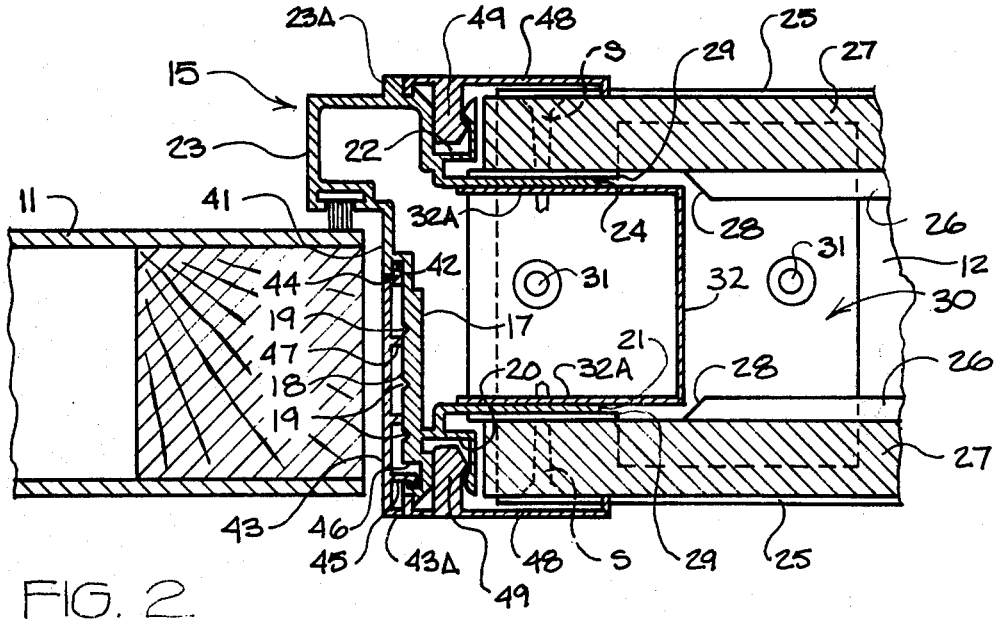
FIG. 2 is a fragmentary sectional view of the assembly of structural members seen along line 2—2 in FIG. 1.

FIG. 2 shows a typical jamb assembly 15 for the door 11. The principal component is the elongated member or stud 17 having an outer face 18 provided with a plurality of parallel and elongated grooves 19. One elongated margin of the stud 17 is formed with an outwardly opening slot 20 and an anchor flange 21 set inwardly of the slot 20 and directed away from the face 18. The opposite elongated margin of the stud 17 is formed with an outwardly opening slot 22 formed on an elongated stop rail 23, and inwardly of the slot 22 is a second anchor flange 24 which is parallel to the flange 21.

Figure 3:
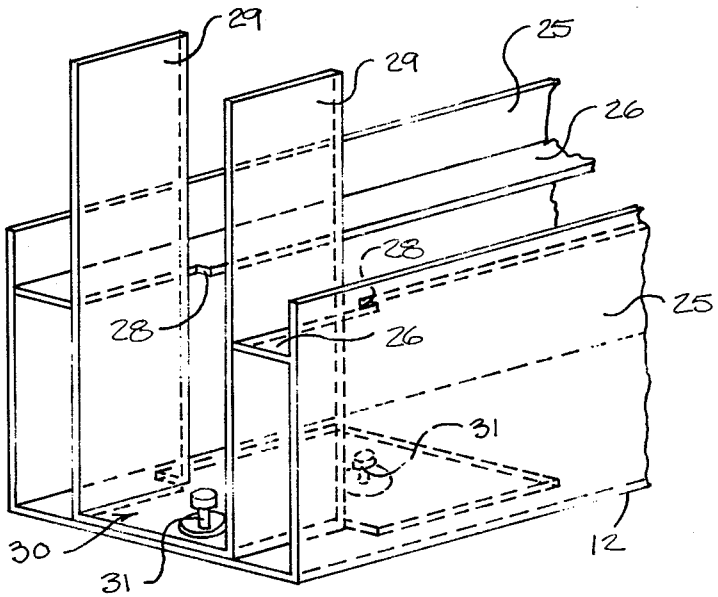
FIG. 3 is a fragmentary perspective view of the floor mounted support for the vertical members which make up the door jamb; the view being taken at line 3—3 in FIG. 1.

The stud 17 is secured in position in the manner seen in FIGS. 2 and 3 where the base channel 12 has the legs 25 of the upwardly opening channel formed with inwardly directed lips 26 which form supports for the bottom edge of the wall panels 27. A portion of each lip 26 is notched at 28 to accommodate the legs of an anchor clip 30 which has its base held in place by suitable fasteners 31 driven through the base and channel 12 into the floor 13. When the clip 30 has been secured, the bottom end of the stud 17 is moved into position with its anchor flanges 21 and 24 located flat against the inside surfaces of the anchor clip legs 29. Either before or after locating the stud 17, a reinforcing support channel 32 may be located with its side flanges 32A inside the stud anchor flanges 21 and 24. The channel 32 extends from the floor channel 12 to the ceiling channel 14 and is primarily used when the door opening does not extend to the ceiling. The wall panels 27 then are positioned on the lips 26 and against the outer faces of the clip legs 29. The components are secured by inserting self tapping screws S through the panels 27 and into the adjacent clip legs 29, stud anchor flanges 21 and 24, and flanges 32A. A number of such screws S are spaced vertically along the panels 27 to firm up the assembly. The opposite jamb assembly 15 (not shown) having the same form is installed in a like menner, and is similarly secured from its bottom or floor end portion, and is supported by the reinforcing channel 32.

Figure 4:
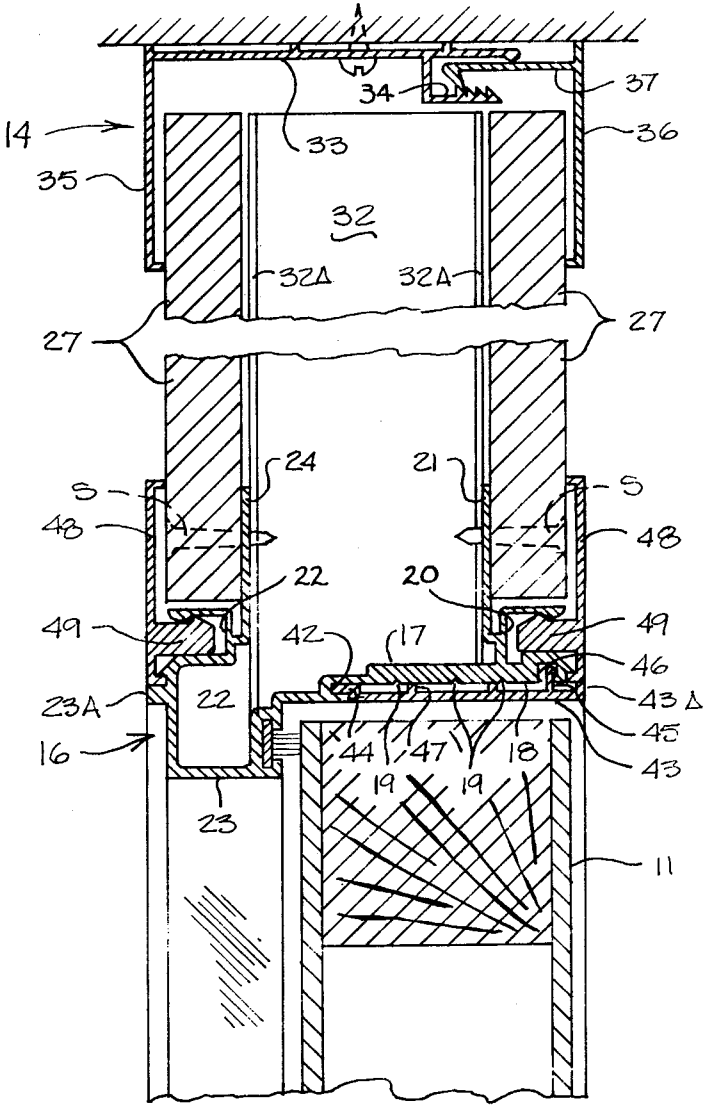
FIG. 4 is a fragmentary sectional view of the assembly of structural members seen at line 4—4 in FIG. 1.

The pair of jamb assemblies 15 are connected in proper plumbed relation by the header assembly 16 which is seen in FIG. 4. The joint formed between the opposite ends of the header 16 and the upper ends of the jambs 15 are mitered to make a neat appearance. It is seen in FIG. 4 that the header is a member having the same configuration and parts as those described for the stud 17 seen in FIG. 2. Since the same member can be used in both places there is a great saving of material and very little work in mitering a joint and having it fit neatly. The description of the stud 17 will apply equally to the header assembly 16 and like reference numerals have been applied thereto. In positioning the header, the anchor flanges 21 and 24 are placed in the space between the wall panels 27, and self tapping screws S are driven through the panels and into the flanges 21 and 24. The opposite margins of the panels 27 are mounted in the ceiling channel 14 which includes a first member 33 formed with a toothed catch slot 34 along one margin and an exposed flange 35 along its opposite margin. A second member 36 forms an opposite flange from flange 35, and is provided with a locking flange 37 which engages in a tooth of the catch slot 34. Since the support channel 32 is located between the panels 27, the member 36 can be pressed in tight against the panels 27 to lock the tooth on flange 37 in the catch slot 34.

Once the jam assemblies 15 and header 16 have been properly installed in the manner above described, the next step is to secure the door hinges 38 in position. In FIG. 1, the hinges 38 are shown spaced along the left hand jamb assembly 15, and a representative hinge installation is shown in FIG. 5 in connection with the hinge plate 39 which is secured against the face 18 of the left hand jamb stud 17. It is to be noted from the view of FIG. 2 that the jamb stud 17 (and this will be the indentical structure for the left hand jamb stud) has its face 18 set lower than the plane of the face portion 41, and the face 18 extends under the portion 41 so as to form a recess 42 for a purpose presently to appear. This construction of the jamb stud 17 shown in FIG. 2 is understood to be also present in the jamb stud 17 of FIG. 5. Accordingly, the hinge plate 39 is set flush against the stud face 18 and its thickness is sufficient to have the exposed surface of the hinge plate 39 substantially in alignment and flush with the face portion 41. It has been noted in FIG. 2 that the stud face 18 is formed with grooves 19, and it now appears from FIG. 5 that the grooves 19 are utilized to locate the hinge screws 40 which will be of a self tapping character to penetrate the thick portion of the stud 17. Each of the hinges 38 is mounted in the manner shown in FIG. 5.

Once the door hinges 38 have been properly mounted, the various trim members may be installed. It is seen in FIG. 2 that a trim strip or member 43 which extends the full heighth of the right hand jamb stud 17 is formed with a flange 44 along one margin which is adapted to fit into the groove 42. Next to the opposite margin of the trim strip 43 there if a locking finger 45 located to snap fit into a receiving slot 46 in the stud face 18. The back side of the trim strip 43 is formed with lands 47 in order to stiffen this member and prevent oil canning. The left hand jamb stud 17 is finished between the hinge plates 39 by similar trim strips 43 which are cut in lengths to fit the space between the hinge plates 39, and these trim strips 43 present the faces thereof flush with the hinge plates 39. It can be seen in FIG. 4 that the header member 16 is similarly formed to receive a trim strip 43, and its physical configuration is the same as that described for the trim strip 48 in FIG. 2 and similar reference numerals are applied to denote the several parts thereof.

The outwardly exposed vertical and horizontal margins of the door opening are finished off by a common trim strip which is shown in FIG. 2 at 48. This trim strip presents an outer face which is flush with the outer flange 43A of the trim strip 43, and the trim strip 48 is secured by a locking finger 49 snap fitting into the channel 20 in the stud 17. The opposite face of the jamb assembly is finished off by a similar trim strip 48 which is positioned by finger 49 being snap fitted into the groove 22. Trim strip 48 lies flush with a bead 23A on the margin of the door stop 23. In a similar manner trim strip 48 (FIG. 4) are installed across the header in a like manner and similar reference numerals denote similar parts. The view of FIG. 1 shows that the header 16 and the jamb assemblies 15 meet in mitered corners 50. It is understood that the mitered fit is formed by suitably cutting the above described member at the desired angle (usually 45°) to obtain a neat and flush fit. The self tapping screws S are usually sufficient to hold the jamb studs 17 and the cooperating header member in proper position. The trim strips are supported from these members and require no separate self tapping screws or other means in addition to the snap fit mounting.

A modification has been shown in FIG. 6 where the panels 27 at one side of the door opening are extended to a vertical wall W. The assembly at the door 11 is similar to the disclosure in FIG. 2 and will not be discribed as similar reference numerals will be applied to the various parts and components in order to simplify the description. The means for securing the wall panels 27 to the vertical wall W is in the form of a stud 51 which is formed with a flat face 52 butting against the wall W and with outwardly opening channels 53 extending along each of the margins of the stud 51. Each channel 53 supports an anchor flange 54, which flanges 54 perform the same function as the flanges 21 and 24 on the stud 17. The stud 51 cooperates with a bottom clip 55 secured through the bottom channel 12 and into the floor 13 by the element 31. The clip 55 has opposite upwardly directed arms 56 which are located on the outside of the anchor flanges 54 and against the inner-face of the wall panels 27. Again self tapping screws S are inserted at spaced positions vertically along the panels 27 to penetrate the clip arms 56 and the anchor flanges 54. This means of securing the wall panels 27 to the vertical wall W is completed by placement of finishing strips 48 of the character previously described, where the anchor fingers 49 are snap fitted into the respective channels 53. The principal difference between stud member 51 and the jamb stud member 17 is that stud 51 is not formed with the door stop 23, and has a flat outer face 52 which is the equivalent of the face on the jamb stud 17 formed when the finishing strip 43 is in place.

Figure 7:
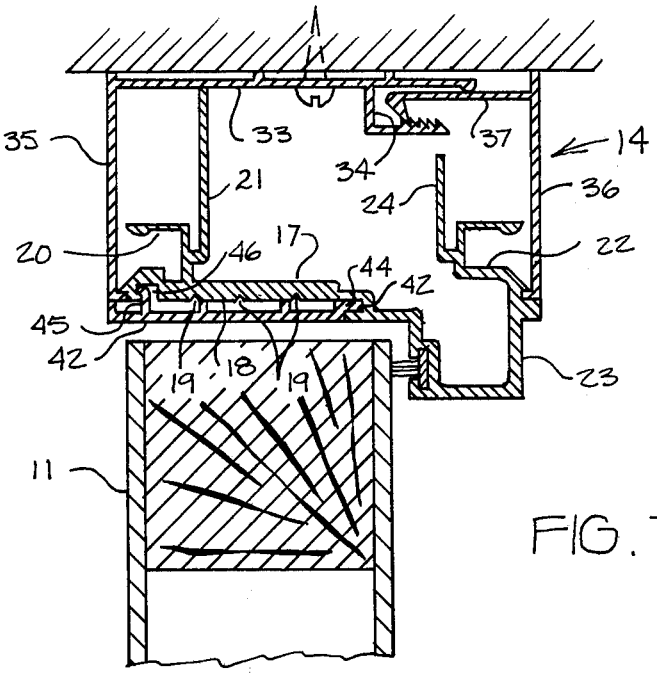
FIG. 7 is a further sectional view of a modification.

There has been described above in connection with FIG. 4 the mounting of the header 16 for a door opening, where the header is spaced at some desired distance below the ceiling. When the door opening extends to the ceiling line, the resulting assembly is seen in FIG. 7. The components shown in FIG. 7 have characteristics previously described in FIG. 4. Accordingly, it will not be necessary to repeat the detailed description, but an understanding of the assembly will be obtained by the use of similar reference numbers applied to the various parts.

Figure 8:
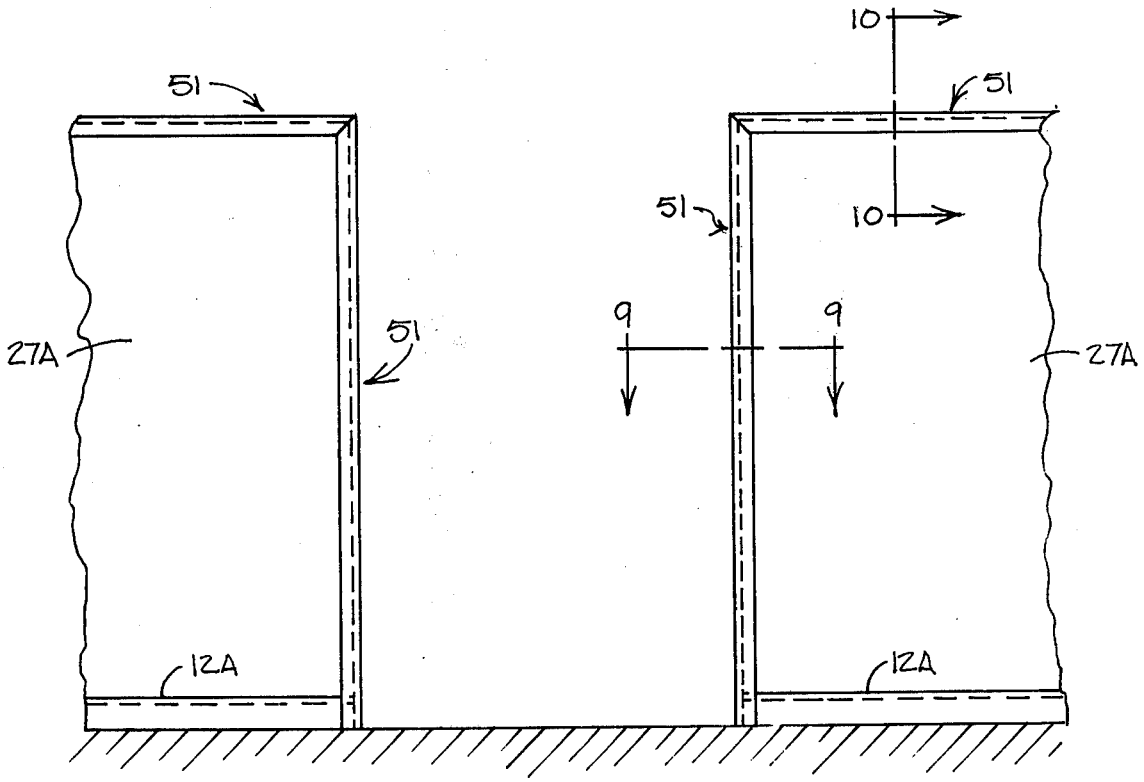
FIG. 8 is a fragmentary elevational view of a low partition using the structural member of this invention.
Figure 9:
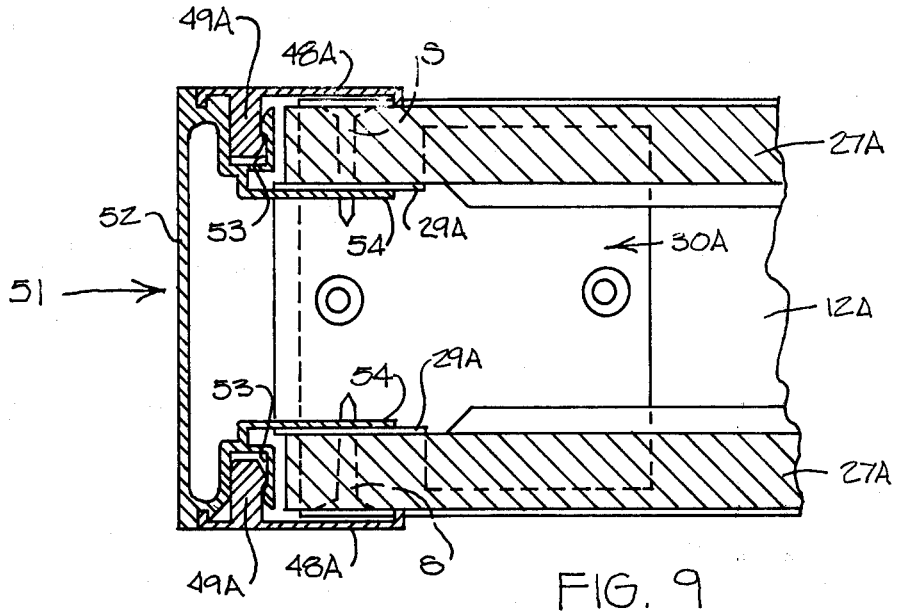
FIGS. 9 and 10 are sectional views taken at lines 9—9 and 10—10 respectively in FIG. 8.
Figure 10:
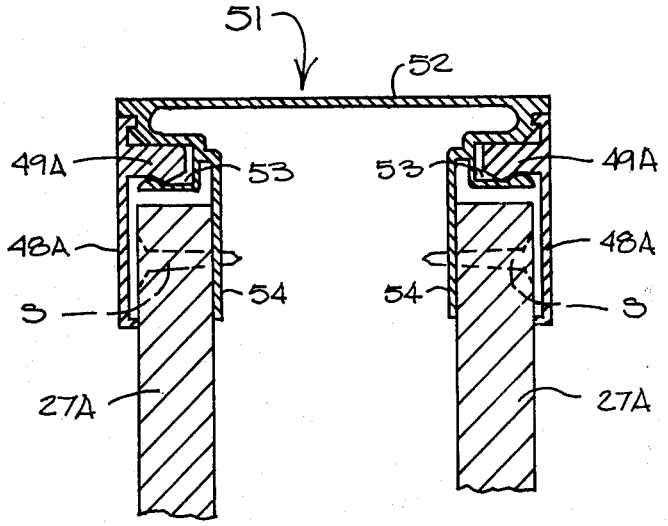

An outstanding advantage to be realized from the use of the structural members or studs heretofore described is shown in FIGS. 8, 9 and 10. In these views the structural members or stud 51 has great utility in connection with its ability to frame and finish off the margins of panels 27A forming low partitions in a room or other space where low partitions are useful to divide off working areas without extending the panels to the ceiling. The floor mounted channels 12A are similar to the channels 12 of FIGS. 1 and 3, and as shown in FIG. 9 the means for modifying the channels 12A and for anchoring the channels by clip means 30A follows the description given for FIG. 2. It can be seen that the vertical margin of the low panels 27A are neatly finished by the stud 51 having the anchor flanges 54 cooperating with the arms 29A of the clip 30A to support the panels 27A by means of the self tapping screws S. Finishing strips 48A are mounted as before described by the snap fit in the slots 53 of locking fingers 49A. The upper margin of the respective panels 27A are strengthened and finished off by placing member 51 as shown in FIG. 10. Similar parts and components in this view are pointed out by reference numerals previously utilized.

in addition to the finishing strips utilized in the two assemblies of FIGS. 2, 4, 9 and 10, it is to be particularly noted that the principal structural members have two generally similar configurations. These members are shown in the jamb stud 17 and in the stud 51, and it can be seen that these two structural members differ only in that the member 17 requires a door stop and means to receive the finishing strips 18 so as to provide a flush face similar to the flush face 52 on member 51. These members 17 and 51 may be formed in suitable lengths for economical transportation to a job site, and there the members may be cut to the desired dimensions for framing a door opening, for securing wall panels to vertical walls or horizontal ceilings, and to finish the margins of low partitions. It is observed in comparing members 17 and 51 that each comprises an elongated body having side margins, an elongated slot located adjacent and extending along each side margin and directed to open oppositely, and an anchor flange positioned adjacent each slot and extending in parallel but spaced relation away from the elongated body at substantially 90°. Furthermore, each of the elongated slots is conformed with one free standing wall and an opposite wall connected to the body to adjacent anchor flange. The free standing wall readily accepts sufficient movement to receive the attachment finger 49 or 49A when the finishing strips 48 and 48A are pressed into final position. The member 17 has other structural characteristics which are adapted for use in framing a door opening, where as the member 51 is formed with a plane flat face for abutment with a wall or other structure or to present a clean exposed surface for the purpose of finishing off a low partition or a wall run.

Significant savings may be realized by using structural members of the character herein described, and the physical configuration of such members enhances the speed with which an installation may be completed as there are required only simple tools since a majority of the components are of the character requiring only a snap fit to complete installation.

What is claimed is:

1. A door mounting assembly for insertion in a panelled wall system, said assembly comprising: spaced apart jamb studs and a header member; said header member abutting said jamb studs at the upper ends thereof, said jamb studs and header member being selected from the same structural form having an elongated flat face flanked along one margin with a slot and an anchor flange and flanked along the opposite margin with a door stop rail and a slot and an anchor flange; jamb stud anchor means engaged with said anchor flanges; a finishing strip carried adjacent said elongated flat faces of said jamb studs and header member; and trim strips carried by said slots flanking said elongated flat faces of said jamb studs and said header member, said finishing strips and door stop rails defining the door receiving opening in the panelled wall system and said trim strips framing the door opening.

2. The door mounting assembly of claim 1 wherein said elongated flat faces of said jamb studs and header member have a raised portion adjacent the door stop rail formed with a first slot and have an anchor slot adjacent said one margin; and each of said finishing strips has a tongue along one margin seated in said first slot and a rib aligned to fit in said anchor slot and hold said finishing strips in position.

3. The door mounting assembly of claim 1 wherein each of said trim strips is formed with a locking rib adapted to fit into said flanking slots for said elongated flat faces of said jamb studs and header member.

4. The door mounting assembly of claim 1 wherein said jamb stud anchor means comprises a clip having spaced legs to substantially match the spacing of said anchor flanges on said structural form for said jamb studs, and means engaged with said anchor flanges and said clip legs securing the flanges and legs together.

* * * * *